United States Patent [19]

Renton

[11] 4,166,719

[45] Sep. 4, 1979

[54] TESTING OF AQUEOUS SOLUTIONS

[75] Inventor: Stanley Renton, Penkridge, England

[73] Assignee: Albright & Wilson Limited, Oldbury, Warley, England

[21] Appl. No.: 721,066

[22] Filed: Sep. 7, 1976

[30] Foreign Application Priority Data

Dec. 18, 1975 [GB] United Kingdom ..... 51801/75

[51] Int. Cl.[2] ..... G01N 31/22

[52] U.S. Cl. ..... 23/230 R; 422/56

[58] Field of Search ..... 23/230 R, 253 TP; 204/51

[56] References Cited

U.S. PATENT DOCUMENTS 3,552,928 1/1971 Fetter ..... 23/253 TP 4,033,720 7/1977 Silvestri ..... 23/230 R

*Primary Examiner*—Arnold Turk

*Attorney, Agent, or Firm*—Frishauf, Holtz, Goodman & Woodward

[57] ABSTRACT

Aqueous solutions such as chromium plating solutions are tested by contacting the solution with a water permeable medium such as a folded filter paper, causing the solution to diffuse upwardly through the medium and contacting separate portions of the diffusing solution in the medium with a water soluble ferrocyanide salt and with a water soluble iron salt respectively. The test may be performed when a filter paper, whose ends have been impregnated respectively with potassium ferrocyanide and a ferrous salt.

8 Claims, 1 Drawing Figure

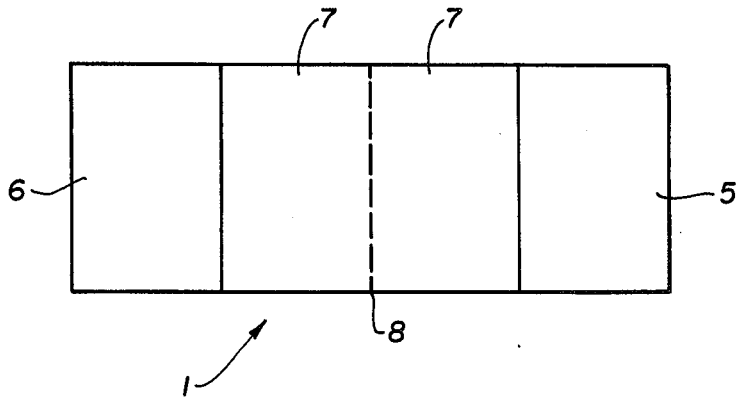
7
7
6
5
8
1

TESTING OF AQUEOUS SOLUTIONS

The present invention relates to methods and materials for testing aqueous solutions, which are applicable to the control of electroplating baths, especially chromium electroplating baths.

Certain electroplating baths have been found to be sensitive to the presence of traces of metal impurity. For example, trivalent chromium plating baths sometimes develop characteristic bands of discolouration at certain current densities. As described in U.S. Application No. 702,374 which issued as U.S. Pat. No. 4,038,160 on July 26, 1977 of which I am co-inventor, these bands may be caused by the presence of traces of metallic impurities. The aforesaid copending Application describes how such bands may often be prevented by addition to the bath of potassium ferrocyanide. However, I have found that excess of potassium ferrocyanide adversely affects trivalent chromium plating.

My invention provides a rapid method for detecting the presence of harmful excesses of either the ferrocyanide or certain of the commoner metallic impurities, so that appropriate remedial action can be taken without delay.

According to one aspect of my invention there is provided a method of testing an aqueous solution which comprises contacting the solution with a water permeable medium, causing the solution to diffuse upwardly through the medium and contacting separate portions of the diffusing solution in the medium with a water soluble ferrocyanide salt and with a water soluble iron salt respectively.

Typically the contact between the diffusing solution and the two salts is ensured by impregnating separate parts of the medium with the two salts, the impregnated parts being disposed in such a way as to intercept separate portions of diffusing solution. Preferably the impregnated parts should be readily visible to an external observer so as to facilitate the detection of any colour changes.

The permeable medium is preferably a cellulosic material such as filter paper or chromatography paper and the insertion will be described primarily in terms thereof. However, any medium which is capable of causing aqueous solutions to diffuse upwardly therethrough, when its lower part is immersed, and which is chemically inert to the diffusing solution, may in principle be employed. Generally speaking any material suitable for liquid phase chromatography will be applicable to this invention as will be apparent to those skilled in the art. Preferably the medium is substantially colourless so as to permit observation of small colour changes.

According to a particular embodiment our invention provides a means for testing aqueous solutions comprising a water permeable paper, separate, externally visible, parts of which are impregnated with a water soluble ferrocyanide salt and with a water soluble iron salt respectively.

A particularly convenient form of test paper according to our invention comprises a strip of permeable paper such as filter paper, which can, for example, be rectangular or any similar convenient shape, a part at or near one end of which has been impregnated with the ferrocyanide and a part at or near the other end of which has been impregnated with the iron salt, preferably leaving an unimpregnated central part between the two impregnated parts. In use, such a paper may be bent or folded about the unimpregnated part, so as to permit the latter to be contacted with the solution, leaving the two impregnated parts unimmersed. The solution diffuses up each immersed arm of the paper, which separates out suspended solids, so enabling any colour change in either arm to be more readily detected.

Test papers according to the invention may conveniently be obtained by preparing rectangular strips of permeable paper and immersing the two ends of each strip respectively in solutions of the two salts, for sufficient time to permit the two solutions to diffuse into separate, preferably non-overlapping parts of the paper. The paper may then be dried, for example, in an oven.

The drawing depicts a rectangular strip test paper 1 having a ferrocyanide impregnated end portion 5 and an iron impregnated end portion 6 separated by the unimpregnated central portion 7 which contains the fold line 8. The preparation of said rectangular strip test paper 1 is described in detail in Examples 1 and 2 hereinafter.

The tests according to the invention may alternatively be performed using two separate test papers impregnated respectively with the two salts. If the water permeable medium is non-coherent or brittle in nature a suitable support means may be provided. For example, it is possible to perform the tests using a thin layer of silica gel supported on a plate, or in the case of powdery of gelatinous media, to support the medium in a column (preferably of glass or similar transparent material.)

The ferrocyanide salt is preferably a tetra alkali metal or ammonium ferrocyanide e.g. potassium ferrocyanide. The iron salt may be a ferric or preferably a ferrous salt, preferably of a mineral acid, e.g. a chloride, nitrate or sulphate.

If a blue stain forms on contact between the solution being tested and the ferrocyanide, then the solution contains an excess of the metallic impurities, whereas a blue stain forming on contact between the solution and the iron salt indicates an excess of ferrocyanide. The invention may be applied to the control of electroplating from a trivalent chromium electrolyte by testing the bath in accordance with the invention to determine whether either ferrocyanide or metallic impurities are present in excessive amounts. If an excess of either is present the appropriate remedial action is taken for example by adding to the bath a small amount of a precipitant for ferrocyanide or a soluble ferrocyanide respectively. The precipitant for ferrocyanide is conveniently a water soluble salt of a transition metal which forms an insoluble ferrocyanide, such as iron. The procedure may be repeated until no blue stain is formed in the test. According to a peferred method an aliquot of trivalent chromium plating solution is taken and ferrocyanide is added, stepwise thereto. The solution is checked after each addition with the test paper. The end point in mls. ferrocyanide per liter of plating solution represents a maximum. In practice, preferably, about 50% of this amount of ferrocyanide is added to the bath, followed by a further addition e.g. 25% as required.

EXAMPLE 1

Test papers were each prepared by dipping one end of a rectangular strip of filter paper in 20% w/v solution of tetra potassium ferrocyanide and the other end in a 20% w/v solution of ferrous chloride. The solutions were each allowed to diffuse part way towards the centre of the strip, which was then dried in an oven.

EXAMPLE 2

A trivalent chromium plating solution, after working satisfactorily for several weeks, developed a fault which comprised the formation of dark smudges at current densities of between 100 and 200 amps per square foot. A test paper prepared according to Example 1 was folded across the unimpregnated central portion, which was dipped in the bath. The electrolyte diffused towards both ends of the paper and produced a blue stain near the ferrocyanide impregnated end, indicating the presence of metallic impurities.

A 10% w/v aqueous solution of tetra potassium ferrocyanide was added in 4 ml. increments, allowing 30 minutes after each addition and then repeating the test. After the second addition, a blue stain was observed at the iron impregnated end of the paper. 2 ml. of 20 w/v ferrous chloride solution was added whereafter no stain was observed. Commercial plating was resumed and the bath functioned satisfactorily.

We claim:

1. A method of determining the presence in an aqueous electroplating electrolyte containing suspended solids of (i) excess trace metals which react with ferrocyanide or of (ii) excess ferrocyanide comprising contacting a portion of said electrolyte with a first portion of a water permeable cellulosic medium, said medium containing at least three portions, a first portion which is adapted to be contacted by said electrolyte and which is free of ferrocyanide and iron salts, a second test portion which is impregnated with a water soluble ferrocyanide salt and is free from iron salt and is in contact with said first test portion, and a third test portion which is impregnated with a water soluble iron salt and is free from ferrocyanide salt and is also in contact with said first portion, whereby a first part of said electrolyte diffuses through said first portion which separates out suspended solids and then contacts said second portion and a second part of said electrolyte diffuses through said first portion and then contacts said third portion, to indicate whether said electrolyte contains an excess of (i) said trace metals or of (ii) ferrocyanide.

2. A method according to claim 1 wherein the cellulosic medium is filter paper.

3. A method according to claim 2 wherein the ferrocyanide salt is potassium ferrocyanide.

4. A method according to claim 2 wherein the iron salt is selected from the group consisting of ferrous chloride, ferrous sulphate and ferrous nitrate.

5. Means for testing aqueous solutions comprising a water permeable paper containing at least three portions, a first water permeable portion which is free of ferrocyanide and iron salts, said first portion being adapted to be immersed in the solution being tested, and second and third test portions, said second test portion being impregnated with a water soluble ferrocyanide salt and being free from iron salt, and said third test portion being impregnated with an iron salt and being free from ferrocyanide salt, each of said second and third portions being contiguous with a part of said first portion.

6. Testing means as claimed in claim 5 wherein the ferrocyanide salt is potassium ferrocyanide.

7. Testing means as claimed in claim 5 wherein the iron salt is selected from the group consisting of ferrous chloride, ferrous sulphate and ferrous nitrate.

8. Testing means according to claim 5 wherein the impregnated second and third portions are separated by said first portion.

* * * * *